United States Patent [19]

Uchida

[11] Patent Number: 4,779,247

[45] Date of Patent: Oct. 18, 1988

[54] WORLD CLOCK

[75] Inventor: Kiyotaka Uchida, Tokyo, Japan

[73] Assignee: Seiko Instruments Inc., Tokyo, Japan

[21] Appl. No.: 36,924

[22] Filed: Apr. 10, 1987

[30] Foreign Application Priority Data

Apr. 24, 1986 [JP] Japan ..... 61-62460[U]

[51] Int. Cl.[4] ..... G04B 19/22; G04B 25/00

[52] U.S. Cl. ..... 368/22; 368/223

[58] Field of Search ..... 368/21, 22, 23–27, 368/82, 223, 239

[56] References Cited

U.S. PATENT DOCUMENTS

| | | | |
|---|---|---|---|
| 3,940,929 | 3/1976 | Nakamura et al. | 368/21 |
| 4,044,545 | 8/1977 | Shimizu | 368/22 |
| 4,435,006 | 3/1984 | Kato | 368/22 |

*Primary Examiner*—Vit W. Miska

*Attorney, Agent, or Firm*—Bruce L. Adams; Van C. Wilks

[57] ABSTRACT

A display panel is mounted to display a world map composed of a plurality of divided local zones. A touch switch panel is opposed to the display panel and comprised of a pair of spaced substrate films deformable inwardly relative to each other, a plurality of segment electrode films formed on the inner surface of one of the substrate films and aligned corresponding to the respective displayed local zones, and a counter electrode film formed on the inner surface of the other end of the substrate films in opposed and normally spaced relation to the plurality of segment electrode films. The touch switch panel is operative when one of the segment electrode films is selectively deformed inwardly relative to the counter electrode film to make electrical contact therewith to effect the activation of the one segment electrode film for designating the one divided local zone corresponding to the activated segment electrode film. The local time of the designated local zone is calculated and displayed in a display device disposed adjacent to the display panel.

11 Claims, 2 Drawing Sheets

FIG. 1
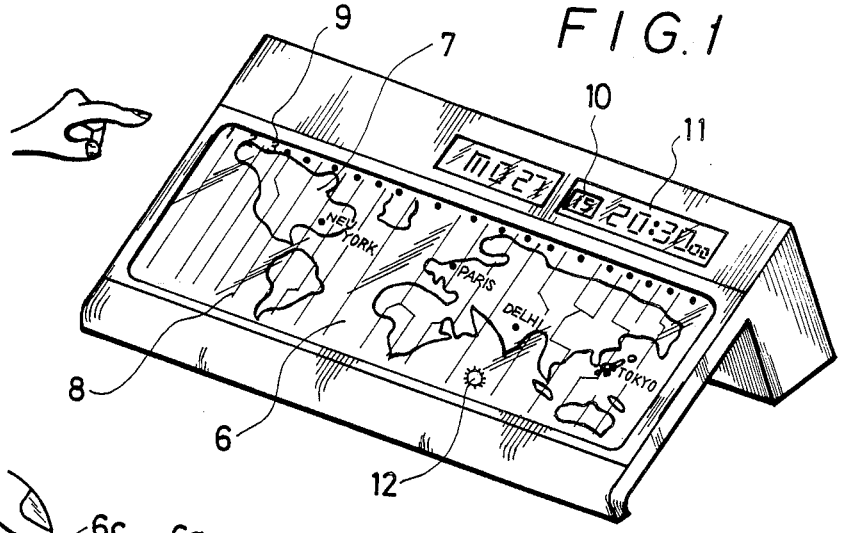
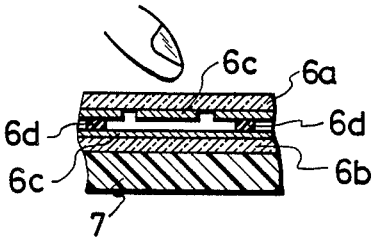
FIG. 2
FIG. 3
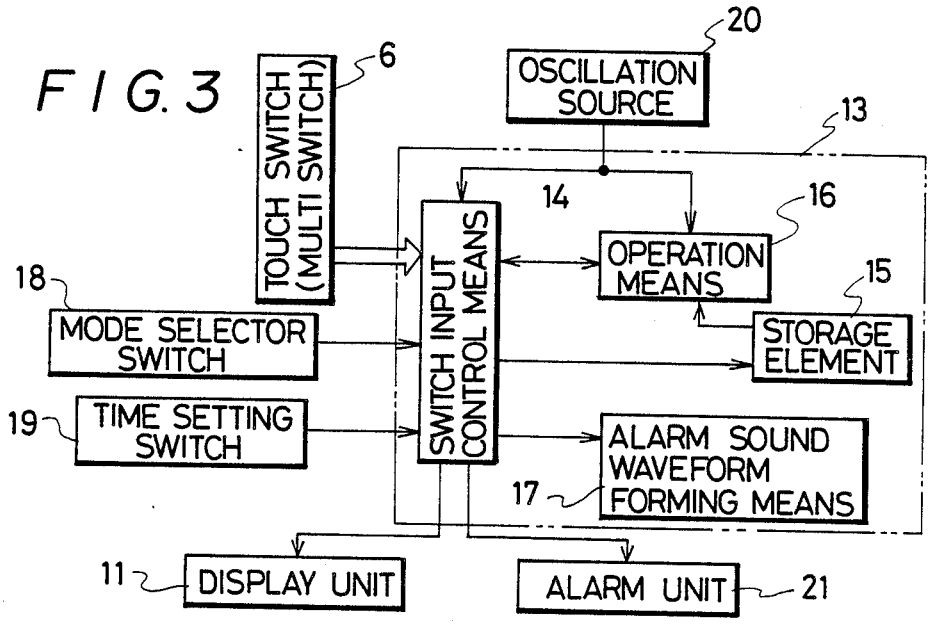

WORLD CLOCK

BACKGROUND OF THE INVENTION

1. Field of the Invention

The present invention relates to a world clock which displays the time information on each region of the world specified arbitrarily by a user.

2. Description of the Prior Art

Conventional world clocks are generally of a watch type as shown in FIG. 4 or of a clock type as shown in FIG. 5.

Almost all the clocks of the watch type operate in a manner of digital display, and the time of each region of the world is indicated by operating a button in a world time mode to select the region and thereby to display the time of the region. The selected region is confirmed by the a flag 1 in the liquid crystal display whose lighting point is transferred by the operation of the button being matched with the name 3 of the region printed on a panel cover, as shown in FIG. 4.

In the case of the clock type, a world time display board 4 whose periphery is divided into twenty-four equal parts to indicate times in a twenty-four hour system is provided around an analog clock, and further a region display board 5 which is rotatable and on which names of world regions are put is provided on the outer peripheral portion of the clock. The time information on each region can be obtained by rotating the region display board 5 so that a basic region (home time region) is matched with the current time of a given region expressed in the twenty-four hour system, and the time of each region of the world can be known by watching the place in which the scales of the two display boards are matched with each other.

The conventional world clocks as described above are troublesome in handling, the time can be known only with respect to a limited number of cities, and it is difficult to know the correspondence of the positional relationship of a region with the time. Moreover, it is impossible to know accurately the time of each region of the world in the case of the watch type.

SUMMARY OF THE INVENTION

In order to solve the above-stated problems, the present invention is designed to have a construction wherein a transparent touch switch having a plurality of independent transparent electrodes formed in correspondence with respective time blocks is superposed on a world map where time difference division lines are drawn and the time of any region in the map is displayed by touching a corresponding place with a finger.

In a world clock constructed as described above, a transparent electrode corresponding with a position on the transparent touch switch which is touched by a finger constitutes a multi-switch operative to convert positional information into a time information to be displayed.

BRIEF DESCRIPTION OF THE DRAWINGS

FIG. 1 shows an overall construction of a world clock according to the present invention;

FIG. 2 shows a section of a touch switch element related to the present invention;

FIG. 3 is a block diagram of a system of the present invention; and

DETAILED DESCRIPTION OF THE PREFERRED EMBODIMENT

Figure 4:
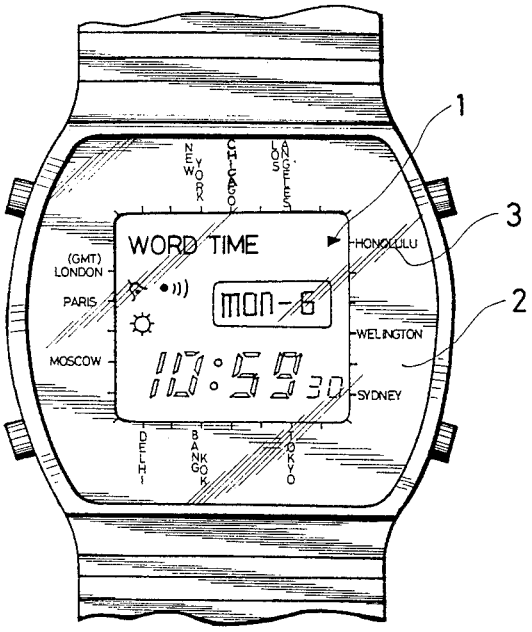
FIG. 4 PRIOR ART
FIGS. 4 and 5 are overall plan views of prior-art world clocks.
Figure 5:
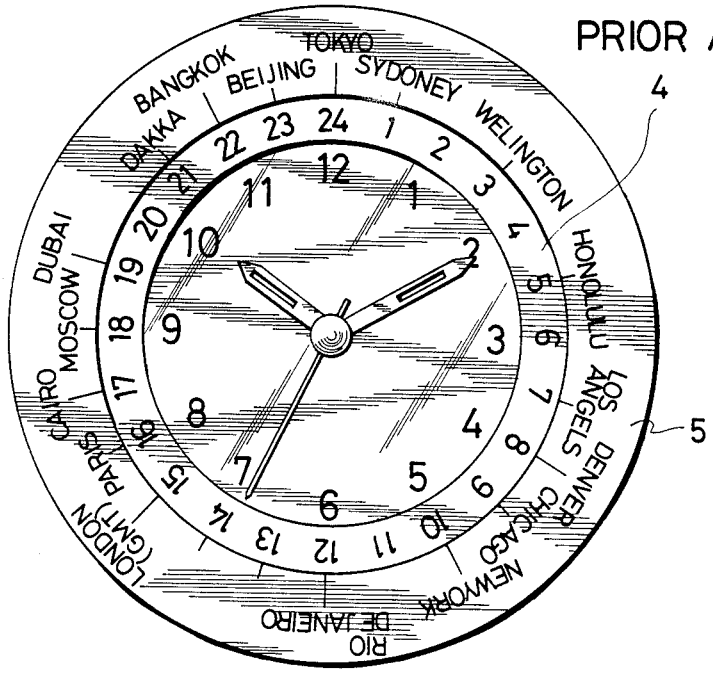
FIG. 5 PRIOR ART

An embodiment of the present invention will be described hereunder on the basis of the drawings. In FIG. 1, a geographic world map, names of main cities and time difference division lines 8 defining a plurality of divided local zones are drawn on a world map panel 7. A transparent touch switch 6 is disposed on the map panel 7, and the cross-sectional structure of the switch and the map panel is shown in detail by FIG. 2. In FIG. 2, marks *6a* to *6d* show the construction of the transparent touch switch, *6a* and *6b* denote front and rear polyester substrate films, *6c* denotes transparent segment electrodes (ITO films or the like) formed by etching, and *6d* denotes spacers for maintaining a minute gap of space between the two polyester elastic films, and the spacers are printed on either of these polyester films.

The simplest structure of the invention is such, for instance, that the plurality transparent electrodes on the front side are formed in a shape corresponding to the respective local zones between the time difference division lines on the map, while the transparent electrode on the rear side is formed on the whole of the side. In this case, these transparent electrodes operate as a multi-switch converting the positional information into the time information by pushing the front and rear transparent electrodes with a finger so that they are deformed to contact and each other. This construction necessitates the transparent electrodes on the front side in the number equal to that of the divided local zones of the world map.

It is advantageous that the number of independent electrodes is as few as possible in view of the connection between the integrated circuit and the touch switch. In this regard, given that the divided local zones are 28 in numbers, for instance, these 28 zones can be covered by electrodes totaling 11 by forming 4 blocks (the number of electrodes is 4) on the front side and 7 divided blocks (the number of electrodes is 7) on the rear side, and by connecting the blocks on the two sides with each other, thus forming a $4\times7$ switch matrix.

In the embodiment ilustrated in FIG. 1, the world map panel 7 and the transparent touch switch 6 superposed on top of the panel 7 constitute the face of the world clock, and liquid crystal panels displaying a time, a calendar, regions, etc. are provided in the upper portion of the world clock and adjacent to the world map panel. It is also possible to superpose a world map panel 7 made of an elastic and soft material on top of the touch switch 6. In the figure, numeral 10 denotes a zone number indicating a specific local zone, and the number of the zone touched by a user so as to know a local time (numeral 9 in FIG. 1 denotes a zone number assigned to each zone and drawn in the upper portion of the map) is displayed simultaneously with the time.

As for main cities, names thereof are put on the map, and it is also possible to display the name of a main city instead of the zone number when it is selected.

Numeral 12 in FIG. 1 is a summer time mark. When a summer time system is adopted in some local zones, switching can be made to a summer time by touching the mark after the zone is selected or designated by the touch switch.

Moreover, an alarm function, if added, can be used in any combination of a region of which the ordinary time is desired to know and another region for which an alarm is desired to sound, by setting the alarm time at an arbitrary time of an arbitrary region.

FIG. 3 is a block diagram of a system of the present embodiment, and an arithmetic processing unit denoted by numeral 13 comprises a storage element 15 wherein the respective zone numbers of zones and time differences thereof are memorized, a switch input control means 14 for controlling switch inputs of a mode selector switch 18, a time-setting switch 19, the touch switch 6, etc. thereby to select the content of a display unit 11, an operation means 16 to conduct arthmetic operations according to the switch inputs, and an alarm sound waveform forming means 17. When an input of the touch switch 6 is given, a time difference information is fetched from the storage element 15 and converted by the arithmetic means 16 so as to display time information.

Since this invention has the construction wherein the touch switch is disposed on or under a world map panel in superposition, as described above, it has an effect that, unlike prior-art world clocks, it enables the quick selection of a place and a time in correspondence with each other by such a visual, direct and simple operation as touching directly with a finger while confirming on the map a region of which the time is desired to know. In addition, it has also an effect that the finishing of the surface of the map enables the attainment of a world clock being abundant in such feelings of high grade as have never been in the prior-art clocks.

What is claimed is:

1. A world clock comprising:

an oscillation source having a quartz oscillator for generating a reference time signal;

an integrated circuit for conducting an arithmetic operation to produce time information according to zone information;

display means for displaying the time information and corresponding zone information;

a world map panel having a world map and a plurality of time difference division lines drawn thereon to define a plurality of divided zones on the world map; and a touch switch having a first elastic film formed with a plurality of thin film electrodes arranged in shapes corresponding to the respective divided zones between adjacent time difference division lines on the world map, a second elastic film formed with at least one thin film counter electrode opposed to the plurality of thin film electrodes formed on the first electric film, and a plurality of spacers for maintaining a minute gap between the first elastic film and second elastic film such that the touch switch operates when one of the thin film electrodes is depressed into contact with the thin film counter electrodes to apply zone information representative of the one divided zone corresponding to the contacted thin film electrode to the integrated circuit.

2. A world clock according to claim 1; wherein the touch switch is disposed on top of the world map panel, and the thin film electrodes formed on the first and second elastic films comprise optically transparent electrodes.

3. A world clock according to claim 1; wherein the touch switch is disposed under the world map panel, and the world map panel comprises an elastic film.

4. A world clock according to claim 1; wherein the integrated circuit includes storage means for storing zone numbers of the respective divided zones and time differences corresponding to the respective divided zones, operation means for calculating a local time of the designated zone in accordance with the content of the storage means, and switch input control means for controlling switch inputs of a mode selector switch, a time setting switch and the touch switch.

5. An apparatus for selectively displaying a local time coresponding to a designated geographic local zone, the apparatus comprising: first display means having a major surface for displaying thereon a geographic map composed of a plurality of divided local zones; designating means opposed to the first display means for designating one of the divided local zones, the designating means comprising a pair of spaced substrate films, at least one of which is deformable inwardly relative to the other, a plurality of segment electrode films formed on the inner surface of one of the substrate films and arranged in correspondence with the respective divided local zones, and a counter electrode film formed on the inner surface of the other of the substrate films in opposed and normally spaced relation to the plurality of segment electrode films, the designating means being operative when one of the segment electrode films is selectively deformed inwardly relative to the counter electrode film to make electrical contact therewith to effect the activation of said one segment electrode film for designating the one divided local zone corresponding to the activated segment electrode film; calculating means for calculating the local time of the designated local zone; and second display means disposed adjacent to the first display means for displaying the calculated local time.

6. An apparatus according to claim 5; wherein the designating means is optically transparent, and including means for mounting the optically transparent designating means on top of the first display means.

7. An apparatus according to claim 6; wherein the segment electrode films and the counter electrode film comprise indium tin oxide films.

8. An apparatus according to claim 5; including means for mounting the first display means on top of and in contact with the designating means, and wherein the first display means comprises an elastic film deformable toward the designating means to effect the deformation of the segment electrode films through the first display means.

9. An apparatus according to claim 5; wherein the pair of substrate films comprise a pair of elastic films.

10. An apparatus according to claim 9; wherein the pair of elastic films comprise a pair of polyester films.

11. An apparatus according to claim 5; wherein the designating means includes a spacer disposed between the spaced substrate films for normally maintaining the space therebetween.

* * * * *